US008962540B2

(12) United States Patent
Toda

(10) Patent No.: US 8,962,540 B2
(45) Date of Patent: Feb. 24, 2015

(54) LUBRICATING OIL COMPOSITION

(75) Inventor: Masatoshi Toda, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 483 days.

(21) Appl. No.: 12/996,980

(22) PCT Filed: Apr. 21, 2009

(86) PCT No.: PCT/JP2009/057908

§ 371 (c)(1),
(2), (4) Date: Mar. 9, 2011

(87) PCT Pub. No.: WO2009/150900

PCT Pub. Date: Dec. 17, 2009

(65) Prior Publication Data

US 2011/0152143 A1 Jun. 23, 2011

(30) Foreign Application Priority Data

Jun. 11, 2008 (JP) ..... 2008-153353

(51) Int. Cl.
*C10M 137/02* (2006.01)
*C10M 141/10* (2006.01)
*C10M 163/00* (2006.01)

(52) U.S. Cl.
CPC ..... *C10M 163/00* (2013.01); *C10M 2203/1025* (2013.01); *C10M 2207/026* (2013.01); *C10M 2207/028* (2013.01); *C10M 2207/262* (2013.01); *C10M 2207/289* (2013.01); *C10M 2209/084* (2013.01); *C10M 2215/08* (2013.01); *C10M 2215/28* (2013.01); *C10M 2219/046* (2013.01); *C10M 2219/089* (2013.01); *C10M 2223/043* (2013.01); *C10M 2223/049* (2013.01); *C10N 2210/02* (2013.01); *C10N 2220/021* (2013.01); *C10N 2220/022* (2013.01); *C10N 2230/02* (2013.01); *C10N 2230/06* (2013.01); *C10N 2230/08* (2013.01); *C10N 2230/18* (2013.01); *C10N 2230/52* (2013.01); *C10N 2240/08* (2013.01)
USPC ..... 508/441; 508/391; 508/408; 508/442

(58) Field of Classification Search
USPC ..... 508/441, 442
See application file for complete search history.

(56) References Cited

U.S. PATENT DOCUMENTS

| | | | | |
|---|---|---|---|---|
| 4,634,543 | A * | 1/1987 | Okada et al. | 252/78.5 |
| 5,382,374 | A * | 1/1995 | Takemitsu et al. | 252/73 |
| 7,534,749 | B2 * | 5/2009 | Egawa et al. | 508/580 |
| 7,786,059 | B2 * | 8/2010 | Buitrago | 508/434 |
| 2004/0192562 | A1 | 9/2004 | Morita | |
| 2006/0135379 | A1 | 6/2006 | Buitrago | |
| 2006/0166844 | A1 | 7/2006 | Egawa et al. | |
| 2007/0179068 | A1 | 8/2007 | Shiga et al. | |
| 2009/0275491 | A1 | 11/2009 | Komatsubara et al. | |
| 2010/0075877 | A1 | 3/2010 | Koga | |
| 2010/0137176 | A1 * | 6/2010 | Aoki et al. | 508/552 |

FOREIGN PATENT DOCUMENTS

| | | | |
|---|---|---|---|
| CN | 1091152 | A | 8/1994 |
| CN | 1570048 | A | 1/2005 |
| EP | 2 067 845 | A1 | 6/2009 |
| JP | 7-258675 | | 10/1995 |
| JP | 2000-109875 | | 4/2000 |
| JP | 2003-147379 | | 5/2003 |
| JP | 2003-193085 | | 7/2003 |
| JP | 2004-182931 | | 7/2004 |
| JP | 2006-176775 | | 7/2006 |
| JP | 2007-169570 | | 7/2007 |
| WO | WO 2004/058928 | A1 | 7/2004 |
| WO | WO 2006/129888 | A1 | 12/2006 |
| WO | WO 2007/052833 | A1 | 5/2007 |
| WO | WO 2008/038667 | A1 | 4/2008 |

OTHER PUBLICATIONS

Extended European Search Report issued Apr. 25, 2012 in patent application No. 09762331.8.
International Search Report issued Jul. 14, 2009, in Patent Application No. PCT/JP2009/057908 (with English-language translation).
Toshio Sakurai, Tribology Sosho 1 Shinban Junkatsu no Butsuri Kagaku, Kabushiki Kaisha Saiwai Shobo, Dec. 1, 1978, pp. 63, 262.
Japanese Office Action issued Apr. 23, 2013, in Japan Patent Application No. 2008-153353.
Office Action issued Feb. 4, 2013 in Chinese Patent Application No. 200980123093.4 (with English Translation of Category of Cited documents).

* cited by examiner

*Primary Examiner* — Ellen McAvoy
(74) *Attorney, Agent, or Firm* — Oblon, Spivak, McClelland, Maier & Neustadt, L.L.P.

(57) ABSTRACT

To provide a lubricating oil composition including a base oil which is composed of a mineral oil and/or a synthetic oil and which has a viscosity index of 95 or higher, and (A) an alkenylsuccinimide in an amount of 0.1 to 2.0 mass %, (B) an acidic phosphite diester having a C6 to C10 hydrocarbon group in an amount of 0.1 to 2.0 mass %, and (C) at least one species selected from among a perbasic alkaline earth metal sulfonate, a perbasic alkaline earth metal phenate, and a perbasic alkaline earth metal salycilate, in an amount of 0.001 to 0.3 mass %, with respect to the total amount of the composition. When employed in an automobile shock absorber, the composition enhances the frictional force at an interface between an oil seal and a piston rod of an automobile shock absorber, reduces the friction coefficient at an interface between a piston rod and a guide bush, suppresses foaming to thereby enhance driving stability during travel of the automobile, and improves riding comfort even when the automobile travels while receiving a lateral load exerted by small steps present on the road surface.

12 Claims, No Drawings

LUBRICATING OIL COMPOSITION

CROSS-REFERENCE TO RELATED APPLICATIONS

This application is a US National Stage Application of PCT/JP2009/057908, filed on Apr. 21, 2009, the text of which is incorporated by reference, and claims priority to Japanese Patent Application 2008-153353, filed on Jun. 11, 2008, the text of which is also incorporated by reference.

TECHNICAL FIELD

The present invention relates to a lubricating oil composition. More particularly, the present invention relates to a lubricating oil composition suitable for various hydraulic oils. Particularly when employed in an automobile shock absorber, the lubricating oil composition enhances the frictional force between an oil seal and a piston rod, improves driving stability of an automobile during travel, and improves riding comfort even when an automobile travels while receiving a lateral load exerted by small steps present on the road surface.

BACKGROUND ART

Lubricating oil for a shock absorber in automobiles is employed mainly for damping vibration in order to attain optimum attenuation force and maintain driving stability.

Hitherto, lubricating oils for a shock absorber in automobiles have exhibited enhanced vibration damping effect through reducing the friction at a sliding interface between an oil seal and a piston rod, a piston rod and a guide bush, a piston band and a cylinder, etc. in a shock absorber (see, for example, Patent Documents 1 and 2).

However, due to recent construction of well-maintained roads such as highway networks, automobile drivers more frequently have the opportunity for high-speed driving. During such high-speed driving, micro-vibration is often generated through tires and in some cases impairs driving stability. Under such micro-vibration conditions, damping force is difficult to obtain. Therefore, it has been revealed that such micro-vibration cannot be suppressed by a conventionally developed shock-absorber lubricating oil which reduces friction.

Some subsequent studies have revealed that the micro-vibration can be suppressed through enhancing the frictional force between an oil seal and a piston rod, resulting in enhanced-level driving stability during high-speed driving (see, for example, Patent Document 3).

However, a shock-absorber lubricating oil which enhances the frictional force between an oil seal and a piston rod also increases the friction coefficient at a sliding interface other than the interface between an oil seal and a piston rod; e.g., the interface between a piston rod and a guide bush. As a result, when an automobile employing such a shock absorber oil travels on a manhole of a road (i.e., a road having small steps), a load lateral to the shock absorber (normal to the piston rod) is applied, and the friction coefficient between a piston rod and a guide bush increases. In this case, the thus-generated vibration cannot be damped, thereby impairing riding comfort.

Riding comfort is also varied by the foaming property of the shock absorber oil. Specifically, even when a shock absorber oil has an appropriate friction coefficient, when a large amount of foam is generated in the oil, the intrinsic performance of the oil cannot be attained, thereby impairing riding comfort.

Thus, in order to solve these problems, there is demand for a shock absorber lubricating oil which enhances the frictional force between an oil seal and a piston rod; which can reduce the friction coefficient at the other sliding interfaces, such as between a piston rod and a guide bush; and which suppresses foaming.

Meanwhile, since a lubricating oil for automobile shock absorbers is also employed in a cold district, high flowability must be also ensured at low temperature. However, in general, improvement in low-temperature flowability may impair riding comfort. Therefore, the low-temperature flowability must be improved while riding comfort is maintained.

Patent Document 1: Japanese Patent Application Laid-Open (kokai) No. Hei 5-255683

Patent Document 2: Japanese Patent Application Laid-Open (kokai) No. 2000-192067

Patent Document 3: Japanese Patent Application Laid-Open (kokai) No. 2003-147379

DISCLOSURE OF THE INVENTION

Problems to be Solved by the Invention

Under such circumstances, an object of the present invention is to provide a lubricating oil composition which, when employed in an automobile shock absorber, enhances the frictional force at an interface between an oil seal and a piston rod of an automobile shock absorber, which reduces the friction coefficient at an interface between a piston rod and a guide bush, which suppresses foaming to thereby enhance driving stability during travel of the automobile, and which improves riding comfort even when the automobile travels while receiving at the shock absorber a lateral load exerted by small steps present on the road surface.

Means for Solving the Problems

The present inventors have conducted extensive studies in order to develop a lubricating oil composition having the aforementioned suitable properties, and have found that the object can be attained by incorporating, into a specific base oil, an alkenylsuccinimide, an acidic phosphite diester having a specific (in number of carbon atoms) hydrocarbon group, and a perbasic alkaline earth metal sulfonate, phenate, or salicylate. The present invention has been accomplished the basis of this finding.

Accordingly, the present invention provides the following:

[1] a lubricating oil composition comprising a base oil which is composed of a mineral oil and/or a synthetic oil and which has a viscosity index of 95 or higher, and (A) an alkenylsuccinimide in an amount of 0.1 to 2.0 mass %, (B) an acidic phosphite diester having a C6 to C10 hydrocarbon group in an amount of 0.1 to 2.0 mass %, and (C) at least one species selected from among a perbasic alkaline earth metal sulfonate, a perbasic alkaline earth metal phenate, and a perbasic alkaline earth metal salicylate, in an amount of 0.001 to 0.3 mass %, with respect to the total amount of the composition;

[2] a lubricating oil composition as described in [1] above, wherein the base oil has a kinematic viscosity of 2 to 20 $mm^2/s$ as measured at 40° C. and a viscosity index of 100 or higher;

[3] a lubricating oil composition as described in [1] or [2] above, wherein the base oil has a flash point of 150° C. or higher;

[4] a lubricating oil composition as described in any of [1] to [3] above, wherein the alkenylsuccinimide (A) is a mono-type or a bis-type polybutenylsuccinimide having a polybutenyl group with a molecular weight of 500 to 1,500;

[5] a lubricating oil composition as described in any of [1] to [4] above, wherein the ingredient (B) is an acidic phosphite diester having a C8 alkyl group;

[6] a lubricating oil composition as described in any of [1] to [5] above, wherein the ingredient (C) is calcium sulfonate having a base value, as determined through JIS K2501 (perchloric acid method), of 200 to 800 mgKOH/g;

[7] a lubricating oil composition as described in any of [1] to [6] above, which further contains (D) a viscosity index improver; and

[8] a lubricating oil composition as described in any of [1] to [7] above, which is a lubricating oil for use in an automobile shock absorber.

Effects of the Invention

The present invention enables provision of a lubricating oil composition which, when employed in an automobile shock absorber, enhances the frictional force at an interface between an oil seal and a piston rod of an automobile shock absorber, reduces the friction coefficient at an interface between a piston rod and a guide bush, suppresses foaming to thereby enhance driving stability during travel of the automobile, and improves riding comfort even when the automobile travels while receiving at the shock absorber a lateral load exerted by small steps present on the road surface.

The lubricating oil composition of the present invention exhibits excellent low-temperature flowability while excellent driving stability and riding comfort are maintained. Thus, the composition exhibits excellent intrinsic properties also in a cold district.

BEST MODES FOR CARRYING OUT THE INVENTION

The lubricating oil composition of the present invention has been developed in order to enhance driving stability during travel of the automobile and riding comfort, particularly in the case where a lateral load (i.e., a load normal to the piston rod) is applied. In addition, even when the lubricating oil composition of the present invention is employed in a cold district, excellent driving stability and riding comfort are maintained, and excellent low-temperature flowability is provided.

For enhancing driving stability during driving, particularly during high-speed driving, the frictional force between an oil seal and a piston rod must be increased. For enhancing riding comfort, particularly in the case where a lateral load is applied, the frictional force between a piston rod and a guide bush must be reduced.

As described hereinbelow, a characteristic feature of the lubricating oil composition of the present invention for meeting the requirements resides in that (A) an alkenylsuccinimide, (B) an acidic phosphite diester having a C6 to C10 hydrocarbon group, (C) a perbasic alkaline earth metal sulfonate, etc. in specific amounts are incorporated a specific base oil.

The base oil employed in the lubricating oil composition of the present invention must have a viscosity index of 95 or higher, preferably 100 or higher, more preferably 105 or higher. Through employment of such a base oil, riding comfort, particularly in the case where a lateral load is applied to the automobile during driving, can be effectively enhanced, and low-temperature flowability is effectively improved.

In the present invention, when a plurality of base oils are employed in combination, properties including viscosity index are determined as those of the mixed oil.

The base oil is generally a mineral oil or a synthetic oil. No particular limitation is imposed on the type and other properties of mineral oil and synthetic oil, so long as the oils have the aforementioned properties. Examples of the mineral oil include paraffin-based mineral oil, intermediate mineral oil, and naphthene-based mineral oil, which are produced through a routine refining method such as solvent refining or hydrogenation refining.

Examples of the synthetic oil include polybutene, polyolefins (e.g., α-olefin (co)polymers), esters (e.g., polyol-esters, dibasic acid esters, and phosphoric acid esters), and ethers (e.g., polyphenyl ether), alkylbenzenes, and alkylnaphthalenes.

In the present invention, the mineral oil may be used, as the base oil, singly or in combination of two or more species. Alternatively, the synthetic oil may be used, as the base oil, singly or in combination of two or more species. Furthermore, one or more mineral oils may be combined with one or more synthetic oils.

Among these oils, mineral oils, particularly paraffin-based mineral oils; α-olefin polymers such as 1-decene oligomers; and mixtures thereof are preferably employed.

The lubricating oil composition of the present invention is mainly employed as an automobile shock absorber oil. Thus, the base oil preferably has a viscosity (kinematic viscosity), as determined at 40° C., of 2 to 20 $mm^2/s$, more preferably 3 to 15 $mm^2/s$, still more preferably 4 to 10 $mm^2/s$.

The base oil preferably has a flash point of 150° C. or higher, more preferably 155° C. or higher. When the flash point of the base oil is lower than 150° C., foaming is often promoted in use of the oil composition, which may impair riding comfort.

Therefore, it is not preferred to use a base oil to which an excessive amount of low-viscosity base has been added for the purpose of enhancement of low-temperature flowability.

In the present invention, the flash point is generally measured through JIS K2265 (COC method).

In the lubricating oil composition of the present invention, an alkenylsuccinimide is employed as the ingredient (A). Examples of the alkenylsuccinimide include mono-type alkenylsuccinimides represented by formula (I):

(I)

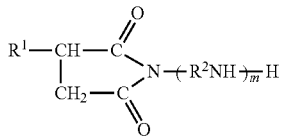

(wherein $R^1$ represents a polyolefin residue, $R^2$ represents a C2 to C4 alkylene group, and m is an integer of 1 to 10), and bis-type alkenylsuccinimides represented by formula (II):

(II)

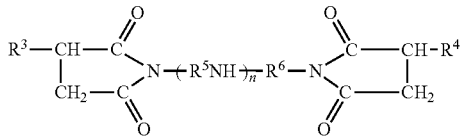

(wherein each of $R^3$ and $R^4$ represents a polyolefin residue, each of $R^5$ and $R^6$ represents a C2 to C4 alkylene group, and n is an integer of 0 to 10).

Generally, the alkenylsuccinimide may be produced through reaction of polyalkylene-polyamine with an alkenylsuccinic anhydride, which is produced through reaction between polyolefin and maleic anhydride. Mono-type alkenylsuccinimide, bis-type alkenylsuccinimide, or a mixture thereof can be selectively produced by modifying the ratio of alkenylsuccinic anhydride to polyalkylene-polyamine in reaction.

In the production of the alkenylsuccinimide, the polyolefin employed as a staring material is a C2 to C6 olefin polymer. Examples of the olefin forming the polyolefin include C2 to C8 α-olefins such as ethylene, propylene, butene (isobutylene, 1-butene), 1-hexene, 2-methylpentene-1, and 1-octene. In the present invention, a polybutene having an average molecular weight of 500 to 1,500 is a preferred polyolefin.

Meanwhile, the polyalkylene-polyamine employed in the reaction is an amine represented by formula (III) or (IV):

$$H_2N—(R^2NH)_m—H \quad (III)$$

$$H_2N—(R^5NH)_n—R^6—NH_2 \quad (IV)$$

(wherein $R^2$, $R^5$, $R^6$, m, and n have the same meanings as defined above).

Examples of the polyalkylene-polyamine include polyethylene-polyamine, polypropylene-polyamine, and polybutylene-polyamine. Of these, polyethylene-polyamine is preferred. In the present invention, either a mono-type or a bis-type polyalkenylsuccinimide, or a mixture thereof may be used.

In the present invention, the alkenylsuccinimide serving as the ingredient (A) is incorporated into the composition in an amount of 0.1 to 2.0 mass % with respect to the total amount of the composition. When the amount is less than 0.1 mass %, sludge dispersion is unsatisfactory, and the effect of enhancing frictional force is poor, whereas when the amount is in excess of 2.0 mass %, seizure occurs, and wearing increases. Thus, the ingredient (A) is preferably incorporated in an amount of 0.2 to 1.0 mass %.

In the lubricating oil composition of the present invention, an acidic phosphite diester having a C6 to C10 hydrocarbon group is employed as the ingredient (B). Examples of the acidic phosphite diester include compounds represented by formula (V);

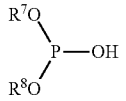

(V)

(wherein each of $R^7$ and $R^8$ represents a C6 to C10 alkyl group or alkenyl group).

In formula (V), the C6 to C10 alkyl group or alkenyl group represented by $R^7$ or $R^8$ may be linear, branched, or cyclic. Examples of the alkyl or alkenyl group include hexyl groups (e.g., n-hexyl, isohexyl, and cyclohexyl), heptyl groups, octyl groups (e.g., n-octyl, isooctyl, and 2-ethylhexyl), nonyl groups, and decyl groups.

Specific examples of the acidic phosphite diester represented by formula (V) include dihexyl hydrogenphosphite, diheptyl hydrogenphosphite, di-n-octyl hydrogenphosphite, di-2-ethylhexyl hydrogenphosphite, dinonyl hydrogenphosphite, and didecyl hydrogenphosphite. Of these, acidic phosphite diesters having a C6 to C9 alkyl (more preferably branched) group are preferred, with acidic phosphite diesters having a C8 alkyl group being particularly preferred.

The acidic phosphite diester serving as the ingredient (B) increases the frictional force between an oil seal and a piston rod.

In the present invention, the aforementioned acidic phosphite diesters may be used singly or in combination of two or more species, as the ingredient (B). The amount of ingredient (B) is 0.1 to 2.0 mass %, with respect to the total mass of the composition. When the amount is less than 0.1 mass %, the effect of increasing the frictional force between an oil seal and a piston rod is poor, whereas when the amount of in excess of 2.0 mass %, the effect commensurate with addition is failed to attain, which is rather disadvantageous from an economical aspect. The amount of ingredient (B) incorporated into the composition is preferably 0.3 to 1.0 mass %.

In the lubricating oil composition of the present invention, at least one species selected from among a perbasic alkaline earth metal sulfonate, a perbasic alkaline earth metal phenate, and a perbasic alkaline earth metal salicylate, as the ingredient (C).

The perbasic alkaline earth metal sulfonate or the like preferably has a base value (JIS K-2501: perchloric acid method) of 200 to 800 mgKOH/g, more preferably 300 to 600 mgKOH/g. When the base value is less than 200 mgKOH/g, the effect of reducing friction coefficient between a piston rod and a guide bush is poor, whereas when the base value is in excess of 800 mgKOH/g, solubility is poor in some case. Both cases are not preferred.

Examples of the alkaline earth metal include calcium, magnesium, and barium. From the viewpoints of performance and availability, calcium is preferred.

The perbasic alkaline earth metal sulfonate employed in the composition may be obtained from various alkaline earth metal sulfonate salts and are generally produced through carbonation of an alkaline earth metal sulfonate salt. Examples of the sulfonic acid include aromatic petroleum sulfonic acid, alkylsulfonic acid, arylsulfonic acid, and alkylarylsulfonic acid. Specific examples include dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, and naphthalenesulfonic acid.

The perbasic alkaline earth metal phenate is generally obtained from an alkylphenol or a sulfidized alkylphenol having a C1 to C100 alkyl group as a phenolic source. Specifically, an alkaline earth metal salt of the phenolic source is transformed to a perbasic form, to thereby obtain the phenate. The perbasic alkaline earth metal salicylate is generally obtained from an alkylsalycilic acid having a C1 to C100 alkyl group as a salicylic source. Specifically, an alkaline earth metal salt of the salicylic source is transformed to a perbasic form, to thereby obtain the salicylate.

Among these compound serving as the ingredient (C), perbasic calcium sulfonate is particularly preferably employed.

The ingredient (C) can reduce friction between a piston rod and a guide bush.

In the present invention, the aforementioned perbasic alkaline earth metal sulfonates, phenates, and salicylates each serving as the ingredient (C) may be used singly or in combination of two or more species. The amount of ingredient (C) incorporated into the composition is 0.001 to 0.3 mass % with respect to the total mass of the composition. When the amount is less than 0.001 mass %, the effect of reducing friction between a piston rod and a guide bush is not fully attained, whereas when the amount is in excess of 0.3 mass %, the effect commensurate with the addition is failed to attain, which is rather disadvantageous from an economical aspect. The amount of ingredient (C) incorporated into the composition is preferably 0.005 to 0.2 mass %.

Preferably, the lubricating oil composition of the present invention further contains an viscosity index improver serving as the ingredient (D).

Examples of the viscosity index improver include a polymethacrylate-based improver, a polyisobutylene-based improver, an ethylene-propylene copolymer-based improver, and a styrene-butadiene hydrogenated copolymer-based improver. Among them, a polymethacrylate having a number average molecular weight of about 10,000 to about 500,000, more preferably about 30,000 to about 200,000 is particularly preferably employed, from the viewpoints of effect and stability. The polymethacrylate may be of non-dispersed type or dispersed-type.

The viscosity index improver can increase viscosity index and reduce viscosity at low temperature. The viscosity index improver is generally used in an amount of 0.3 to 35 mass %, preferably 0.5 to 15 mass %.

So long as the object of the present invention is not impeded, if needed, the lubricating oil composition of the present invention may further contain other additives such as another phosphate ester compound, an ashless dispersant, an antioxidant, a metal deactivator, a defoaming agent, and a seal sweller.

Examples of the phosphate ester compound include an acidic phosphoric acid monoester amine salt formed from an acidic phosphoric acid monoester having a C1 to C8 alkyl or alkenyl group (e.g., monomethyl hydrogenphosphate or monoethyl hydrogenphosphate) and an amine compound having having a C8 to C20 alkyl or alkenyl group. The phosphate ester compound is generally used in an amount of 0.05 to 0.3 mass %, preferably 0.08 to 0.12 mass %.

Examples of the ashless detergent-dispersant include boron-containing succinimides, benzylamines, boron-containing benzylamines, succinic acid esters, and monovalent or divalent carboxamides (carboxylic acid:fatty acid or succinic acid). The ashless detergent-dispersant is generally used in an amount of 0.1 to 20 mass %, preferably 0.3 to 10 mass %.

Examples of the antioxidant include amine-based antioxidants such as alkylated diphenylamine, phenyl-α-naphthylamine, and alkylated naphthylamine; and phenol-based antioxidants such as 2,6-di-t-butylphenol, 4,4'-methylenebis(2,6-di-t-butylphenol). The antioxidant is generally used in an amount of 0.05 to 2 mass %, preferably 0.1 to 1 mass %.

Examples of the metal deactivator include benzotriazole, benzotriazole derivatives, benzothiazole, benzothiazole derivatives, triazole, triazole derivatives, dithiocarbamate, dithiocarbamate derivatives, imidazole, and imidazole derivatives. The metal deactivator is generally used in an amount of 0.005 to 0.3 mass %.

Examples of the defoaming agent include dimethylpolysiloxane and polyacrylate. The defoaming agent is generally added in a very small amount, for example, about 0.0005 to about 0.002 mass %.

EXAMPLES

The present invention will next be described in more detail by way of examples, which should not be construed as limiting the invention thereto. The performance evaluation was carried out through the following methods.

(1) Friction Coefficient of Seal Member

The friction coefficient ($\mu_I$) of a seal member was determined through the following procedure.

Tester: Bounden-type reciprocating kinetic friction tester

Test Conditions:

Oil temperature: 60° C.
Load: 9.8 N
Stroke 10 mm
Speed: 3.0 mm/s
Friction operation: 10 times
Friction Members
Upper friction member: seal member, rubber (NBR)
Lower friction member: chromium-plated steel sheet Evaluation: Friction coefficient $\mu_I$ was measured after completion of 10 sets of friction operation. The greater the friction coefficient $\mu_I$, the more enhanced the driving stability.

(2) Friction Coefficient of Guide Bush

The friction coefficient ($\mu_{II}$) of a guide bush was determined through the following procedure.

Tester: Crank-type reciprocating kinetic friction tester

Test Conditions:

Oil temperature: 20° C.
Load: 392 N
Stroke: ±15.0 mm
Excitation frequency: 1.5 Hz
Friction Members
Upper friction member: guide bush member, copper alloy coated with Teflon (registered trademark)
Lower friction member: chromium-plated rod Evaluation: Friction coefficient $\mu_{II}$ was measured after completion of 10 sets of friction operation. The smaller the friction coefficient $\mu_{II}$, the more excellent the riding comfort.

(3) Foamability

The foaming amount was measured through the following procedure.

Tester: A foaming tester shown in FIG. 1 of Japanese Patent Application Laid-Open (kokai) No. Hei 10-170506

Measurement Conditions:

Jet nozzle diameter: ϕ 1.0 mm
Nozzle height from liquid level: 55 mm
Oil temperature: 60° C.
Oil sample circulation: 1420 mL/min Method of Measurement:

The sample oil was jetted through the nozzle for 30 seconds to the surface of the same oil sample contained in a sample container, and the amount of generated foam (mL) was measured.

The smaller the amount of foam, the better the foamability. That is, the drop in riding comfort can be suppressed.

(4) Traveling Test (Checking of Driving Stability and Riding Comfort)

Method of Experiment:

A five-passenger sedan car (with a multi-cylinder-type shock absorber) was caused to travel on a general concrete-surfaced road having joints and manholes at a speed of 20 to 60 km/h. Four passengers rode in the car and evaluated driving stability and riding comfort with a rating (score).

In terms of driving stability or riding comfort, the standard condition was rated with a score 0.0, and a specific condition was rated at a score within a range of +2.0 to −2.0.

The both scores given by the four passengers were averaged.

(5) Low-Temperature Viscosity

Brookfield (BP) viscosity was measured at −40° C. in accordance with JPI-5S-26-85.

Examples 1 and 2, and Comparative Examples 1 to 3

Lubricating oil compositions having compositional proportions shown in Table 1 were prepared from base oils and additives listed in Table 1. Properties and performance of the oil compositions were measured. Table 1 shows the results.

TABLE 1-1

| | | | Ex. 1 | Ex. 2 |
|---|---|---|---|---|
| Compositional proportions (mass %) | Base oil | Mineral oil 1*1 | 76.531 | 76.531 |
| | | Mineral oil 2*2 | 20.000 | 20.000 |
| | | Mineral oil 3*3 | | |
| | | Mineral oil 4*4 | | |
| | Ingredient (A) | Polyisobutenylsuccinimide (mono-type)*5 | 0.500 | 0.500 |
| | Ingredient (B) | Di (2-ethylhexyl) hydrogenphosphite | 0.600 | 0.600 |
| | Ingredient (C) | Perbasic Ca sulfonate (base value: 537 mgKOH/g, perchloric acid method) | 0.010 | |
| | | Perbasic Ca sulfonate (base value: 405 mgKOH/g, perchloric acid method) | | 0.010 |
| | Ingredient (D) | Viscosity index improver*6 | 1.600 | 1.600 |
| | Others*7 | | 0.759 | 0.759 |

TABLE 1-1-continued

| | | Ex. 1 | Ex. 2 |
|---|---|---|---|
| Properties of compositions | Kinematic viscosity (40° C.) $mm^2/s$ | 11.1 | 11.1 |
| | Kinematic viscosity (100° C.) $mm^2/s$ | 3.13 | 3.15 |
| | Viscosity index | 155 | 157 |
| | BF viscosity (−40° C.) mPa · s | 1300 | 1350 |
| Properties of base oil | Viscosity index | 112 | 111 |
| | Kinematic viscosity (40° C.) $mm^2/s$ | 8.59 | 8.58 |
| | Flash point° C. | 164 | 164 |
| Seal member friction coefficient ($\mu_I$) | | 0.31 | 0.31 |
| Guide bush friction coefficient ($\mu_{II}$) | | 0.040 | 0.038 |
| Foamability (foaming amount mL) | | 30 | 20 |
| Traveling test | Driving stability (score) | +1.8 | +1.8 |
| | Riding Comfort (score) | +1.8 | +1.7 |

TABLE 1-2

| | | | Comp. Ex. 1 | Comp. Ex. 2 | Comp. Ex. 3 |
|---|---|---|---|---|---|
| Compositional proportions (mass %) | Base Oil | Mineral oil 1*1 | 76.541 | | 77.641 |
| | | Mineral oil 2*2 | 20.000 | | 20.000 |
| | | Mineral oil 3*3 | | 75.690 | |
| | | Mineral oil 4*4 | | 20.000 | |
| | Ingredient (A) | Polyisobutenylsuccinimide (mono-type)*5 | 0.500 | 0.500 | |
| | Ingredient (B) | Di (2-ethylhexyl) hydrogenphosphite | 0.600 | 0.600 | |
| | Ingredient (C) | Perbasic Ca sulfonate (base value: 537 mgKOH/g, perchloric acid method) | | 0.010 | |
| | | Perbasic Ca sulfonate (base value: 405 mgKOH/g, Perchloric acid method) | | | |
| | Ingredient (D) | Viscosity index improver*6 | 1.600 | 3.200 | 1.600 |
| | Others*7 | | 0.759 | 0.759 | 0.759 |
| Properties of compositions | | Kinematic viscosity (40° C.) $mm^2/s$ | 11.1 | 10.9 | 11.1 |
| | | Kinematic viscosity (100° C.) $mm^2/s$ | 3.13 | 3.51 | 3.05 |
| | | Viscosity index | 155 | 232 | 144 |
| | | BF viscosity (−40° C.) mPa · s | 1300 | 1350 | 1300 |
| Properties of base oil | | Viscosity index | 112 | 77 | 112 |
| | | Kinematic viscosity (40° C.) $mm^2/s$ | 8.57 | 7.67 | 8.57 |
| | | Flash point° C. | 164 | 138 | 164 |
| Seal member friction coefficient ($\mu_I$) | | | 0.30 | 0.31 | 0.11 |
| Guide bush friction coefficient ($\mu_{II}$) | | | 0.053 | 0.038 | 0.035 |
| Foamability (foaming amount mL) | | | 30 | 120 | 30 |
| Traveling test | Driving stability (score) | | +1.7 | +1.5 | −1.6 |
| | Riding comfort (score) | | +0.0 | −1.5 | +1.8 |

Note:

*1Paraffin-based mineral oil, kinematic viscosity (40° C.) 9.05 $mm^2/s$, viscosity index 109, flash point 174° C.

*2Paraffin-based mineral oil, kinematic viscosity (40° C.) 7.08 $mm^2/s$, viscosity index 115, flash point 164° C.

*3Paraffin-based mineral oil, kinematic viscosity (40° C.) 8.02 $mm^2/s$, viscosity index 74, flash point 154° C.

*4Paraffin-based mineral oil, kinematic viscosity (40° C.) 4.32 $mm^2/s$, viscosity index 83, flash point 138° C.

*5Polybutenyl group, molecular weight 950, base value (perchloric acid method) 40 mgKOH/g

*6Polymethacrylate, number average molecular weight 140,000

*7Mixture containing phenol-based antioxidant, fatty acid amide, fatty acid monoglyceride, acidic phosphoric acid ester amine salt, defoaming agent, and sulfur-containing seal sweller As is clear from Table 1, lubricating oil compositions falling within the scope of the present invention (Examples 1 and 2) prepared from a base oil having a viscosity index of 110 or higher and the ingredients (A), (B), and (C) in appropriate amounts exhibited a friction coefficient $\mu_I$ (frictional force) with respect to a seal member as high as 0.31, a friction coefficient $\mu_{II}$ with respect to a guide bush as low as 0.040 or 0.038, and a small foaming amount (30 or 20 mL). The compositions also exhibited good driving stability and riding comfort of +1.7 or higher. The compositions were found to have a BF viscosity at low temperature (−40° C.) of 1,300 mPa·s, providing good low-temperature flowability.

In contrast, the lubricating oil composition of Comparative Example 1, containing no ingredient (C), exhibited a guide bush friction coefficient $\mu_{II}$ of 0.053, which is higher than that of Example 1 or 2. Therefore, the riding comfort is poor (rating +0.8).

The lubricating oil composition of Comparative Example 2, containing the ingredients (A), (B), and (C) but employing a base oil (flash point: 138° C.) having a viscosity index of 77, exhibited a guide bush friction coefficient of 0.038, which is lower than that of Example 1. However, the foaming amount was so great (120 mL) that riding comfort was considerably impaired (score: −1.5).

The lubricating oil composition of Comparative Example 3, containing no ingredients (A), (B), or (C), exhibited a considerably impaired driving stability (score: −1.6).

INDUSTRIAL APPLICABILITY

When employed as an automobile shock absorber oil, the lubricating oil composition of the present invention enhances the frictional force between an oil seal and a piston rod, to thereby enhance driving stability during travel of the automobile, reduces the friction coefficient between a piston rod and a guide bush, and suppresses foaming, to thereby attain excellent riding comfort, particularly when the automobile travels while the shock absorber receives a lateral load exerted by small steps present on the road surface. In addition, the lubricating oil composition exhibits excellent low-temperature flowability while excellent driving stability and riding comfort are maintained. Thus, the composition exhibits excellent performance also in a cold district.

Thus, the lubricating oil composition of the present invention is useful as a lubricating oil for use in a variety of hydraulic apparatuses. The composition can be effectively employed as a shock absorber lubricating oil, particularly an automobile shock absorber lubricating oil for multi-cylinder type or single cylinder type shock absorbers of four-wheel and two-wheel vehicles.

The invention claimed is:

1. A lubricating oil composition comprising:

a base oil comprising a mineral oil and/or a synthetic oil and which has a viscosity index of 95 or higher and a flash point of 150° C. or higher;

(A) an alkenylsuccinimide in an amount of 0.1 to 2.0 mass %;

(B) an acidic phosphite diester having the formula:

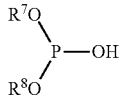

wherein each of $R^7$ and $R^8$ represents a C8 hydrocarbon group, in an amount of 0.3 to 2.0 mass %; and (C) at least one species selected from the group consisting of a perbasic alkaline earth metal sulfonate and a perbasic alkaline earth metal phenate, in an amount of 0.001 to 0.3 mass %, with respect to the total amount of the composition, wherein in a test of the lubricating oil composition in a Bouden-type reciprocating kinetic friction tester, the friction coefficient ($\mu_I$) of a seal member is at least 0.31, and wherein in a test of the lubricating oil composition in a crank-type reciprocating kinetic friction tester, the friction coefficient ($\mu_{II}$) of a guide bush is no greater than 0.40.

2. A lubricating oil composition according to claim 1, wherein the base oil has a kinematic viscosity of 2 to 20 $mm^2/s$ as measured at 40° C. and a viscosity index of 100 or higher.

3. A lubricating oil composition according to claim 1, wherein the alkenylsuccinimide (A) is a mono-type polybutenylsuccinimide having a polybutenyl group with a molecular weight of 500 to 1,500.

4. A lubricating oil composition according to claim 1, wherein the ingredient (C) is calcium sulfonate having a base value, based on JIS K2501 (perchloric acid method), of 200 to 800 mgKOH/g.

5. A lubricating oil composition according to claim 1 further comprising (D) a viscosity index improver.

6. An automobile shock absorber comprising the lubricating oil composition according to claim 1.

7. A lubricating oil composition according to claim 1, wherein the alkenylsuccinimide (A) is a bis-type polybutenylsuccinimide having a polybutenyl group with a molecular weight of 500 to 1,500.

8. A lubricating oil composition according to claim 1, wherein (A) is present in an amount of 0.2 to 1.0 mass; (B) is present in an amount of 0.3 to 1.0 mass %; and (C) is present in an amount of 0.005 to 0.2 mass %.

9. A lubricating oil composition according to claim 1, wherein the viscosity index is 105 or higher.

10. A lubricating oil composition according to claim 1, wherein (A) is a (mono-type) polyisobutenylsuccinimide;

(B) is di(2-ethylhexyl) hydrogenphosphite; and (C) is perbasic Ca sulfonate.

11. A lubricating oil composition according to claim 1, wherein the base oil has a flash point of at least 155° C.

12. A lubricating oil composition according to claim 1, wherein in a traveling test for driving stability and riding comfort, the lubricating oil composition received a score of +1.7 or higher for both driving stability and for riding comfort.

* * * * *